US007438321B2

(12) United States Patent
Peleman

(10) Patent No.: US 7,438,321 B2
(45) Date of Patent: Oct. 21, 2008

(54) BINDING SYSTEM

(75) Inventor: Guido Peleman, Puurs (BE)

(73) Assignee: Unibind (Cyprus) Limited, Nicosia (Cyprus) (CY)

( * ) Notice: Subject to any disclaimer, the term of this patent is extended or adjusted under 35 U.S.C. 154(b) by 495 days.

(21) Appl. No.: 10/978,573

(22) Filed: Nov. 2, 2004

(65) Prior Publication Data

US 2005/0104361 A1 May 19, 2005

(30) Foreign Application Priority Data

Nov. 19, 2003 (BE) ..... 2003/0624

(51) Int. Cl.
*B42D 1/00* (2006.01)

(52) U.S. Cl. ..... 281/21.1; 412/8

(58) Field of Classification Search ..... 281/21.1, 281/15.1, 3.1, 29, 35, 36, 38, 40, 37, 27; 412/36, 33

See application file for complete search history.

(56) References Cited

U.S. PATENT DOCUMENTS

| | | | | |
|---|---|---|---|---|
| 1,466,618 | A * | 8/1923 | Fry | 281/21.1 |
| 2,006,824 | A * | 7/1935 | Cavalero | 281/36 |
| 2,069,211 | A * | 2/1937 | Brown | 281/21.1 |
| 2,290,663 | A * | 7/1942 | Wiser | 281/29 |
| 2,526,270 | A * | 10/1950 | Phillips | 281/21.1 |
| 2,706,645 | A * | 4/1955 | Pitner | 281/29 |
| 3,840,254 | A * | 10/1974 | Shatzkin | 281/21.1 |
| 3,938,831 | A * | 2/1976 | Herman | 281/29 |
| 5,425,554 | A * | 6/1995 | Lamanna | 281/21.1 |
| 2001/0045736 | A1 | 11/2001 | Gogoana | |

FOREIGN PATENT DOCUMENTS

| | | |
|---|---|---|
| BE | 1006292 A3 | 7/1994 |
| EP | 1213155 A1 | 6/2002 |
| GB | 2197256 A | 5/1988 |

* cited by examiner

*Primary Examiner*—Derris H. Banks
*Assistant Examiner*—Jamila Williams
(74) *Attorney, Agent, or Firm*—Bacon & Thomas, PLLC

(57) ABSTRACT

A binding system consisting of a binding back (3) which is provided with a layer of melting glue (7) on the inside, wherein it comprises at least one end leaf (4) made of a rigid material provided with a flexible strip on at least one edge, which strip is at least partly made of a material which adheres well to the above-mentioned melting glue (7) of the binding back (3).

7 Claims, 2 Drawing Sheets

BINDING SYSTEM

BACKGROUND OF THE INVENTION

1. Field of the Invention

The present invention concerns a binding system. More particularly, it concerns a binding system which serves to bind loose leaves and/or documents.

2. Discussion of the Related Art

A binding system which consists of a metal, U-shaped binding back provided with a glue on the inside which melts under the influence of heat, or what is called a melting glue, is already known. In such a known binding back, a bundle of loose leaves and/or documents can be easily bound by putting the leaves with one edge in the binding back, by subsequently heating the binding back in order to make the glue melt and by finally making the binding back cool down in order to make the glue solidify.

A disadvantage is that, with such binding backs, it is not possible to bind a rigid end leaf, for example made of cardboard, as well, since such an end leaf is difficult to open due to the rigidity of such end leaves and of the binding back.

Moreover, rigid end leaves are usually provided with a synthetic coating which does not easily adhere to the melting glue in the above-mentioned metal binding back, which has for a result that such end leaves easily come off the binding back.

A binding system in the shape of a cover consisting of two rigid end leaves is also known, which are each provided via a flexible hinge strip on a metal binding back, whereby, as described above, a layer of glue is provided in this metal binding back for binding the leaves.

Such known binding systems are disadvantageous in that they occupy much space as far as packing and storing is concerned.

Another disadvantage is that such known binding systems cannot be printed with conventional printing machines, because of the thickness of the metal binding back in the above-mentioned covers.

SUMMARY OF THE INVENTION

The present invention aims to remedy one or several of the above-mentioned and other disadvantages by providing a binding system which can be packed and stored in a compact manner and which is provided with end leaves which can be printed by a printer or a printing machine.

To this end, the invention concerns a binding system consisting of a binding back which is provided with a layer of melting glue on the inside and at least one loose end leaf made of a rigid material which is provided with a flexible strip on at least one edge, which strip is at least partly made of a material which adheres well to the above-mentioned melting glue of the binding back.

During the binding, the end leaves with their above-mentioned flexible strip, together with the leaves to be bound, are fixed to the binding back in the usual manner by means of the melting glue in the binding back.

As the flexible strip is made of a material which adheres well to the glue, the end leaves will not easily come off the binding back after the binding.

Thanks to the flexible strip, the end leaf can hinge in relation to the binding back in a simple manner, without being torn or folded, such that a folder which is formed by means of such binding system, retains its original shape when being opened and closed.

As the end leaves are detached from the binding back, such binding systems according to the invention only occupy a limited storage space.

Since loose end leaves are applied with such binding systems, it is possible to provide a print on these end leaves before the actual binding, whereby a conventional printer can be used to this end for example.

According to a preferred characteristic of the invention, the end leaf consists of a carrier made of a rigid material which is provided with a flexible coating on at least one side, whereby the above-mentioned flexible strip is formed of a strip made of this coating extending outside the edge of the above-mentioned carrier.

The coating preferably consists of a carrier, made of a material that adheres well, for example paper, onto which is provided a synthetic layer. Thus, end leaves can be obtained which are easy to maintain thanks to the synthetic layer.

BRIEF DESCRIPTION OF THE DRAWINGS

In order to better explain the characteristics of the invention, the following preferred embodiment of a binding system according to the invention is described as an example only without being limitative in any way, with reference to the accompanying drawings in which.

DESCRIPTION OF SOME PREFERED EMBODIMENTS

Figure 1:
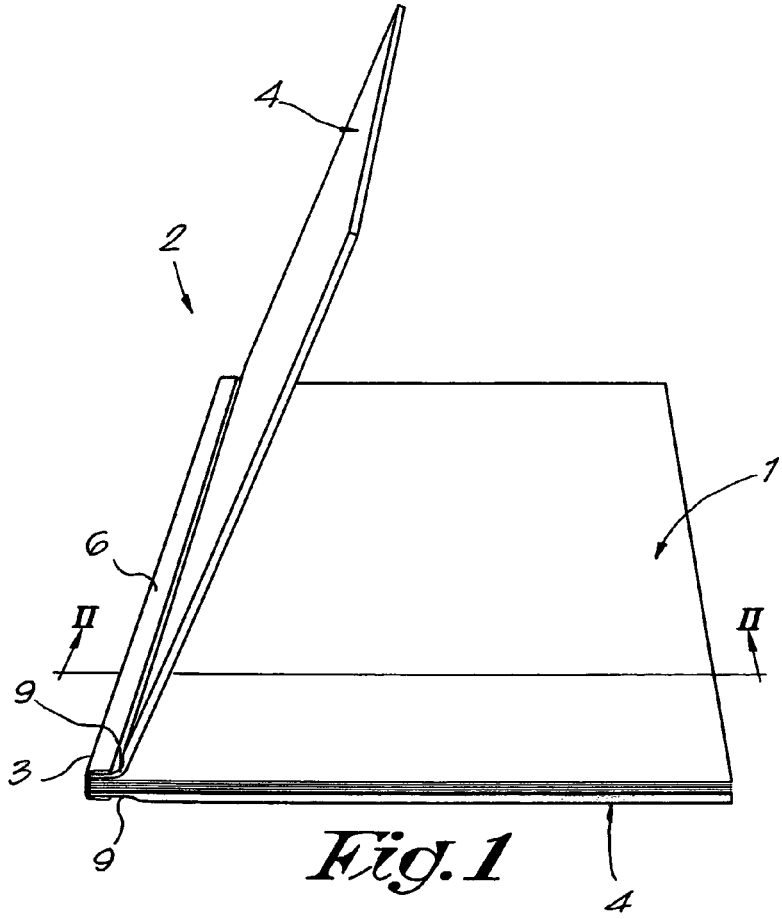
FIG. 1 schematically represents a binding system according to the invention in perspective.

FIG. 1 schematically represents a folder, whereby a bundle of leaves 1 has been bound in a binding system 2 according to the invention, which binding system 2 mainly consists of a U-shaped binding back 3 and two end leaves 4.

Figure 2:
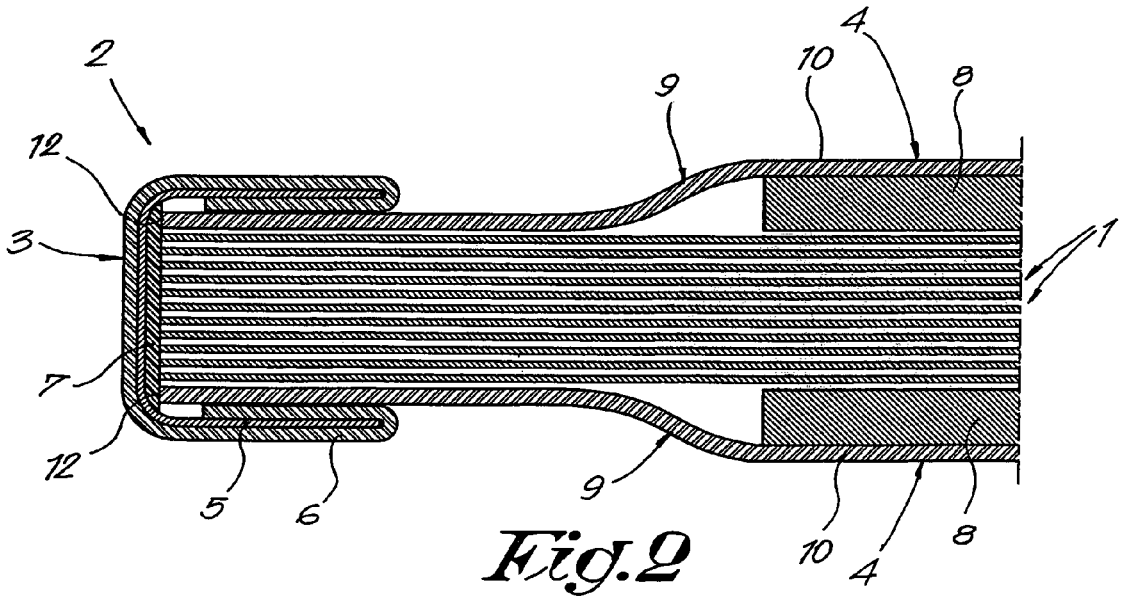
FIG. 2 represents a section according to line II-II in FIG. 1.

The section of FIG. 2 shows that the U-shaped binding back 3 consists of a profile 5, for example made of metal, which is surrounded by a layer of material 6. On the inside of the U-shaped binding back 3 has been provided a layer of melting glue 7.

The above-mentioned end leaves 4 each consist of a leaf 8 made of a rigid material, which can be made for example of cardboard and which is provided with a flexible coating 9 on one side, whereby this coating 9 is provided with a material which adheres well to the above-mentioned layer of melting glue 7, for example paper.

The flexible coating 9 extends from the edge of the above-mentioned leaf 8 past the edge of this leaf 8 and thus forms, together with this protruding part, a flexible strip.

The use of such a binding system 2 according to the invention is very simple and as follows.

The loose end leaves 4 are positioned in the binding back 3 with their above-mentioned flexible strip, together with the leaves 1 to be bound. Next, the binding back 3 is heated in an appropriate manner, as a result of which the melting glue 7 present therein will start to melt and the leaves and end leaves sink in the glue 7.

Finally, the binding back 3 and thus also the glue 7 is cooled down again, so that the glue 7 solidifies again, in order to form a bound whole in this manner.

As a result, the binding system 2 which is obtained in this manner, comprises rigid end leaves 4 which can nevertheless be easily opened by making use of the flexible strip.

It is clear that the end leaves can be provided with a print first, for example by means of a printer.

Figure 3:
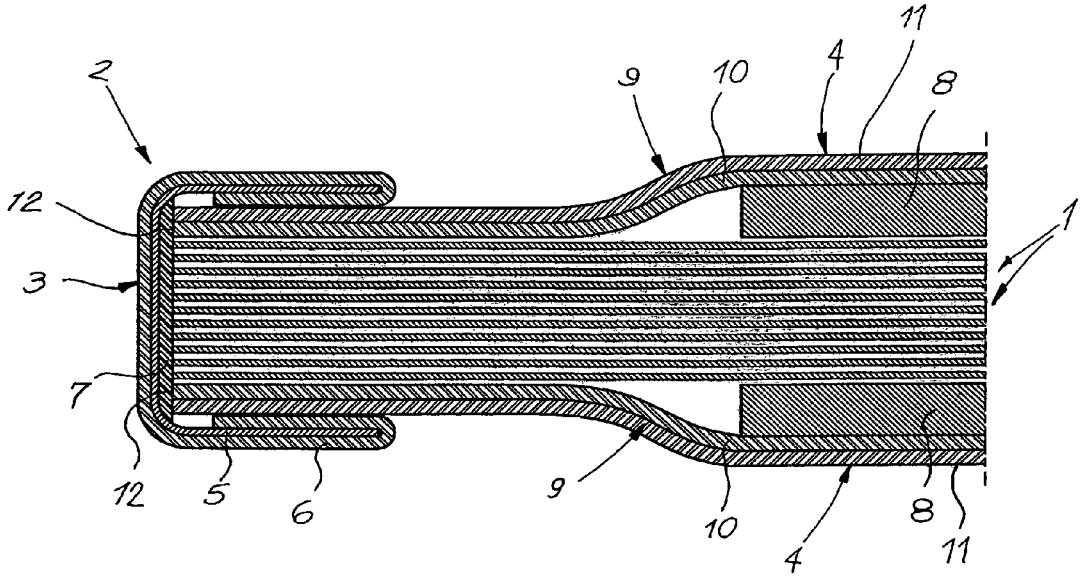
FIG. 3 represents a section similar to that in FIG. 2, but for a variant of a binding system according to the invention.

FIG. 3 represents a variant of a folder, obtained with a binding system 2 according to the invention, whereby, in this case, the flexible coating 9 is made double-layered with a carrier 10, which is made of a material which easily adheres to the melting glue 7, for example paper, and of a synthetic layer 11, for example polyvinyl chloride. The carrier 10 extends a bit past the edge of the leaf 8, to thus obtain a flexible strip.

The use of a binding system 1 according to this varying embodiment is analogous to that of the embodiment from FIGS. 1 and 2.

Figure 4:
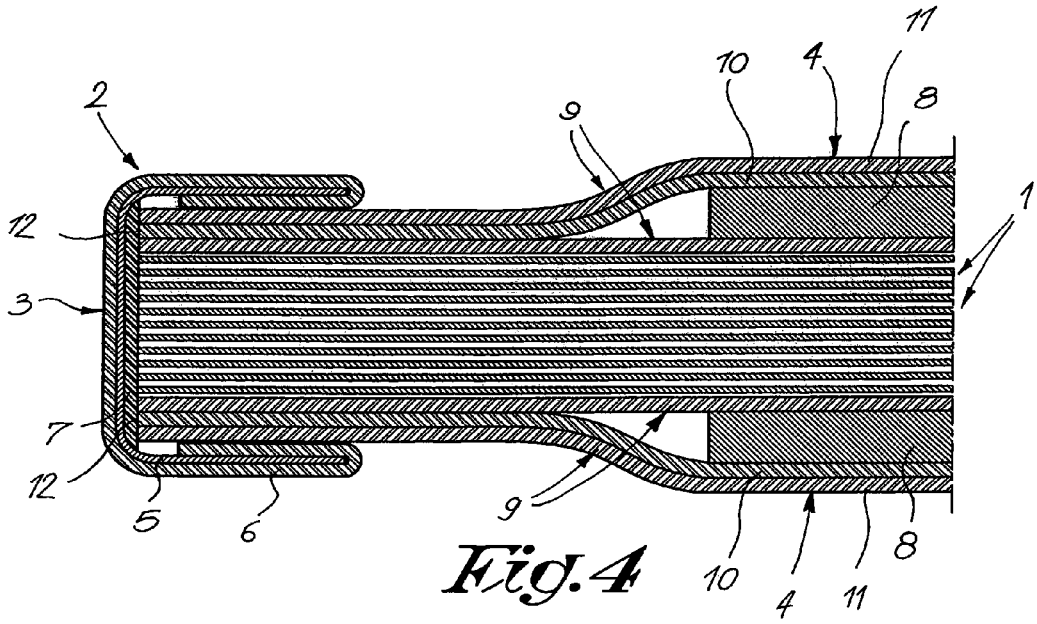
FIG. 4 represents a section similar to that in FIG. 2, but for a varying embodiment of a binding system according to the invention.

FIG. 4 represents another variant of a binding system 2 according to the invention, which consists in that the leaf 8 is provided with a coating 9 on either side, which at least extends from the edge to be bound to past the above-mentioned leaf 8.

The parts extending outside the leaf 8 are connected to each other, for example by means of glue, and thus form a flexible strip.

At least one of both coatings 9 is preferably double-layered, whereby at least one layer is made of a material which adheres well to the melting glue 7.

In the case of FIG. 4, both coatings 9 are glued to each other and cut at a desired length at a distance from the edge of the leaf 8, whereby, along the cutting line, one edge 12 of the carrier 10 is free, whereby this edge 12 adheres well to the melting glue 7 during the binding.

A variant of the invention which is not represented in the figures consists in that the leaf 8 is provided with a coating 9 on both sides, formed of a single layer of material, for example on one side a coating made of a material which adheres to glue, for example paper, and on the other side a coating made of a synthetic material 11, for example polyvinyl chloride.

In this embodiment of a binding system 2, the flexible strip is formed in the same manner as in the case of the embodiment represented in FIG. 4.

The present invention is by no means limited to the above-described embodiment given as an example and represented in the accompanying drawings; on the contrary, such a binding system according to the invention can be made in all sorts of shapes and dimensions while still remaining within the scope of the invention.

The invention claimed is:

1. A binding system comprising a binding back which is provided with a layer of melting glue on an inside surface thereof, and further comprising at least one rigid cardboard end leaf which is provided with first and second flexible coatings on first and second sides thereof and a flexible strip on at least one edge, which strip is at least partly made of a material which is inserted into and adheres well to said melting glue of the binding back; and wherein the flexible strip is formed of parts of said first and second coatings extending past the at least one edge of said end leaf, which parts are fixed to each other and extend outside said end leaf such that end portions of said first and second coatings that form the flexible strip are inserted into said melting glue.

2. The binding system according to claim 1, wherein each of said first and second flexible coatings are formed of a carrier onto which has been provided a flexible synthetic layer and wherein the carrier comprises a material which adheres well to the melting glue of the binding back.

3. The binding system according to claim 2, wherein said carrier is made of paper.

4. The binding system according to claim 1, wherein at least one of the first and second coatings is double-layered, and wherein at least one layer is made of a material which adheres well to the melting glue.

5. The binding system according to claim 2, wherein the synthetic layer is made of a material which can be printed easily.

6. The binding system according to claim 2, wherein the synthetic layer is polyvinyl chloride.

7. An end leaf for use in a binding system having a binding back which is provided with a layer of melting glue on an inside surface thereof, the end leaf comprising:

a rigid cardboard end leaf which is provided with first and second flexible coatings on first and second sides thereof and a flexible strip on at least one edge, which strip is at least partly made of a material which is inserted into adheres well to said melting glue of the binding back; and wherein the flexible strip is formed of parts of said first and second coatings extending past the at least one edge of said end leaf, which parts are fixed to each other and extend outside said end leaf such that end portions of said first and second coatings that form the flexible strip are inserted into said melting glue.

* * * * *